US007775186B2

(12) United States Patent
Sakurai et al.

(10) Patent No.: US 7,775,186 B2
(45) Date of Patent: Aug. 17, 2010

(54) SUPPORTING STRUCTURE FOR A CAMSHAFT, AS WELL AS METHODS FOR MOUNTING AND MANUFACTURING A CAMSHAFT

(75) Inventors: Masahide Sakurai, Nagoya (JP); Katsuhiko Motosugi, Toyota (JP); Manabu Shibata, Nishio (JP)

(73) Assignee: Otics Corporation, Aichi (JP)

( * ) Notice: Subject to any disclaimer, the term of this patent is extended or adjusted under 35 U.S.C. 154(b) by 335 days.

(21) Appl. No.: 11/987,344

(22) Filed: Nov. 29, 2007

(65) Prior Publication Data

US 2008/0283018 A1 Nov. 20, 2008

(30) Foreign Application Priority Data

Dec. 21, 2006 (JP) ..... 2006-344513

(51) Int. Cl.
*F01L 1/04* (2006.01)

(52) U.S. Cl. ..... 123/90.6; 123/90.16; 29/888.1

(58) Field of Classification Search ..... 123/90.6, 123/90.16; 29/888.1
See application file for complete search history.

(56) References Cited

U.S. PATENT DOCUMENTS 5,123,385 A 6/1992 Sado et al.
5,201,246 A 4/1993 Arnold et al.
6,591,713 B2 * 7/2003 Jesel ..... 74/567
2004/0144349 A1 7/2004 Wampula et al.

FOREIGN PATENT DOCUMENTS

| | | |
|---|---|---|
| DE | 32 27 693 | 1/1984 |
| DE | 198 31 772 | 1/1999 |
| EP | 0 458 341 | 11/1991 |
| JP | 01-249904 | 10/1989 |
| WO | 2006/050545 | 3/2006 |

OTHER PUBLICATIONS

European Search Report dated Apr. 25, 2008 for European Application No. 07021948.

* cited by examiner

*Primary Examiner*—Zelalem Eshete
(74) *Attorney, Agent, or Firm*—Wenderoth, Lind & Ponack, L.L.P.

(57) ABSTRACT

A cam lobe is formed as a single part, not formed together with a shaft body. The shaft body penetrates through bearing holes, as well as a mounting hole provided in the cam lobe, which is arranged in between adjacent bearing holes. The bearing holes each in a perfect circular shape can be achieved, since there is no need to divide the bearing holes into two semi-circular arc shaped concave portions. Consequently, a camshaft can be supported so as to rotate smoothly.

3 Claims, 7 Drawing Sheets

SUPPORTING STRUCTURE FOR A CAMSHAFT, AS WELL AS METHODS FOR MOUNTING AND MANUFACTURING A CAMSHAFT

CROSS REFERENCE TO RELATED APPLICATION

This application claims priority from Japanese Patent Application No. 2006-344513 filed Dec. 21, 2006. The entire content of this priority application is incorporated herein by reference.

BACKGROUND OF THE INVENTION

1. Field of the Invention

The present invention relates to a supporting structure for a camshaft, as well as methods for mounting and manufacturing a camshaft.

2. Description of the Related Art

In Japanese Unexamined Patent Publication No. H01-249904, a structure for supporting a camshaft has been disclosed. In this supporting structure for the camshaft, a plurality of cam lobes are fixed to a shaft body, so that the shaft body is rotatably supported by bearings at the both ends of the shaft body, as well as in between adjacent cam lobes. The bearing is a vertical combination of the semi-circular arc shaped concave portion formed in the top surface of the cam housing and the semi-circular arc shaped concave portion formed in the bottom surface of a cap, which is fitted into the cam housing. In other words, a circular bearing hole for supporting the shaft body is composed of vertically united concave portions in a semi-circular arc shape.

SUMMARY OF THE INVENTION

The above-mentioned conventional bearing has a problem that, when the cap is fitted into the cam housing, the center of the axle of the semi-circular arc shaped concave portion in the cap side and the center of the axle of the semi-circular arc shaped concave portion in the cam housing are out of alignment due to dimension tolerances and fitting tolerances. As a result, smooth rotation of the camshaft is in danger of being disturbed.

This invention has been completed based on the above situation, and its purpose is to provide a supporting structure of a camshaft which does not disturb smooth rotation of the camshaft.

The first aspect of the invention is a structure for supporting a camshaft with a supporting member, wherein the camshaft comprises a shaft body of circular cross section and a cam lobe provided in the circumference of the shaft body, the supporting member has a plurality of circular bearing holes arranged on one and the same axis, the cam lobe is a single part not formed integrally with the shaft body, a mounting hole is provided in the cam lobe for allowing the shaft body to penetrate there through, the shaft body penetrates through the plurality of bearing holes and the mounting hole provided in the cam lobe arranged in between the adjacent bearing holes, and the cam lobe is integrally fixed to the shaft body.

The second aspect of the invention is a method for mounting a camshaft to a supporting member, wherein the camshaft comprises a shaft body of circular cross section, as well as a cam lobe provided in the circumference of the shaft body, the supporting member has a plurality of circular bearing holes arranged on one and the same axis, the cam lobe is a single part not formed integrally with the shaft body, a mounting hole is provided in the cam lobe for allowing the shaft body to penetrate there through, the shaft body penetrates through the plurality of bearing holes and the mounting hole provided in the cam lobe arranged in between the adjacent bearing holes, and the cam lobe is integrally fixed to the shaft body.

The third aspect of the invention is a method for manufacturing a camshaft supported by a supporting member, wherein the camshaft comprises a shaft body of circular cross section, as well as a cam lobe provided in the circumference of the shaft body, the supporting member has a plurality of circular bearing holes arranged on one and the same axis, a mounting hole is provided in the cam lobe for allowing the shaft body to penetrate there through, the shaft body penetrates through the plurality of bearing holes and the mounting hole provided in the cam lobe arranged in between the adjacent bearing holes, and the cam lobe is integrally fixed to the shaft body.

These and other objects, features and advantages of the present invention will become more apparent upon reading of the following detailed description along with the accompanied drawings.

DETAILED DESCRIPTION OF THE PREFERRED EMBODIMENTS

With embodiments of the present invention described hereinafter with reference to the accompanying drawings, it is to be understood that the invention is not limited to those precise embodiments, and that various changes and modifications may be effected therein by one skilled in the art without departing from the scope or spirit of the invention as defined in the appended claims.

A bearing member uniting two concave portions in a semi-circular arc shape so as to form a circular shape might disturb smooth rotation of a camshaft since the center of axle of the two concave portions in a semi-circular arc shape would be out of alignment.

In this respect, according to the present invention, a cam lobe is formed as a single part, not being integrally formed with a shaft body. A mounting hole is provided in the cam lobe for allowing the shaft body to penetrate there through. And also, the shaft body penetrates through a plurality of bearing holes, as well as a mounting hole provided in the cam lobe arranged in between the adjacent bearing holes.

Therefore, according to the present invention, the bearing hole in a perfect circular shape can be achieved since there is no need to divide the bearing member into two semi-circular arc shaped concave portions. Consequently, the cam shaft can be supported by the bearing member so that it is rotated smoothly.

Moreover, when the shaft body and the cam lobe are integrated, the external diameter of the part of the shaft body which fits with the bearing hole needs to be larger than the external diameter of the cam lobe, since the cam lobe needs to penetrate through the bearing hole. Therefore, the bearing structure for supporting the camshaft needs to increase in size.

In this respect, according to the present invention, there is no need for the cam lobe to penetrate through the bearing hole, since the cam lobe is a single part, not formed integrally with the shaft body. Hence, it is possible to make the external diameter of the bearing hole smaller, thereby enabling downsizing the bearing structure.

Embodiment 1

In what follows, Embodiment 1 of the present invention is described while referring to FIGS. 1 to 5.

Figure 1:
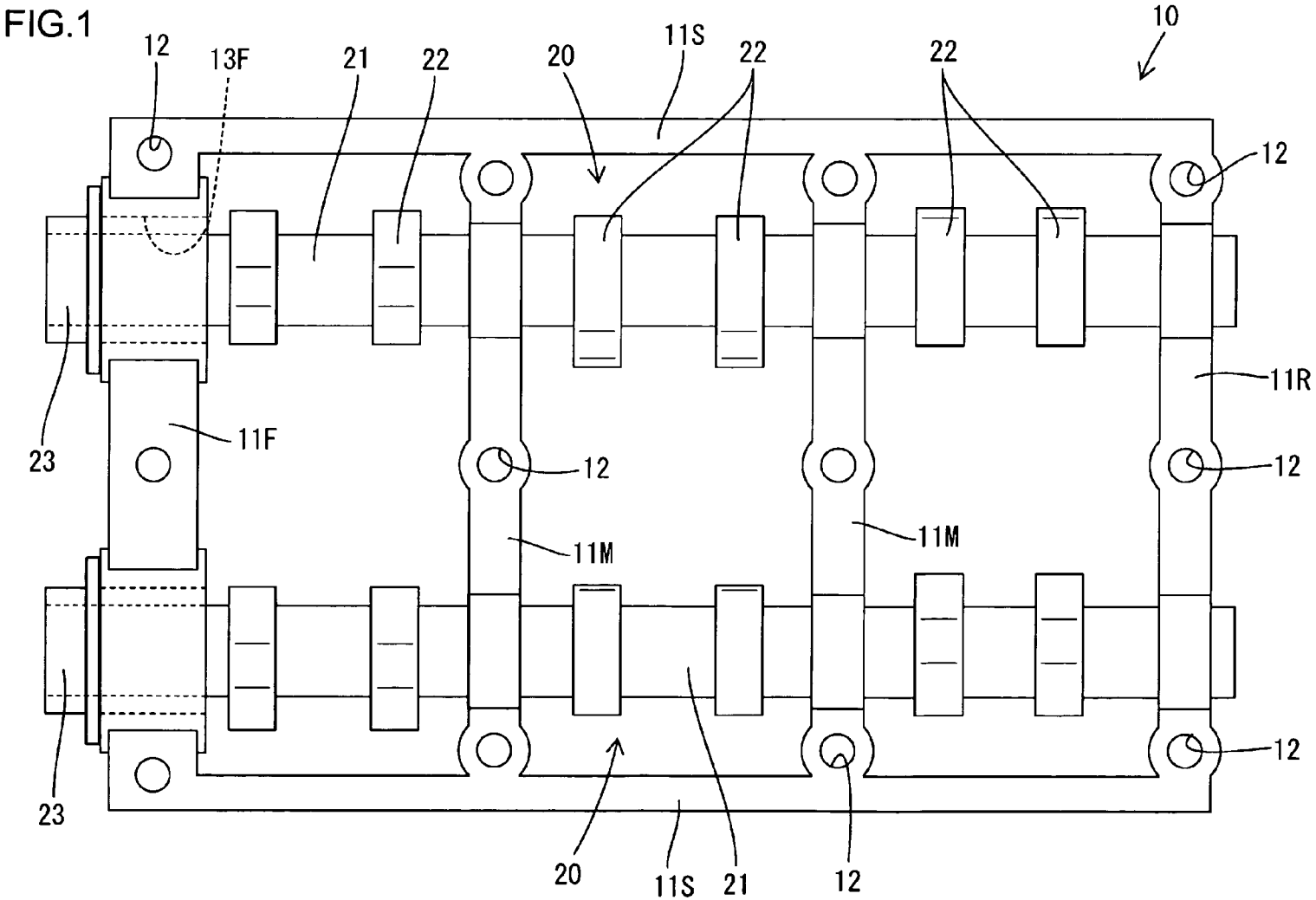
FIG. 1 shows a plan view of Embodiment 1.
Figure 2:
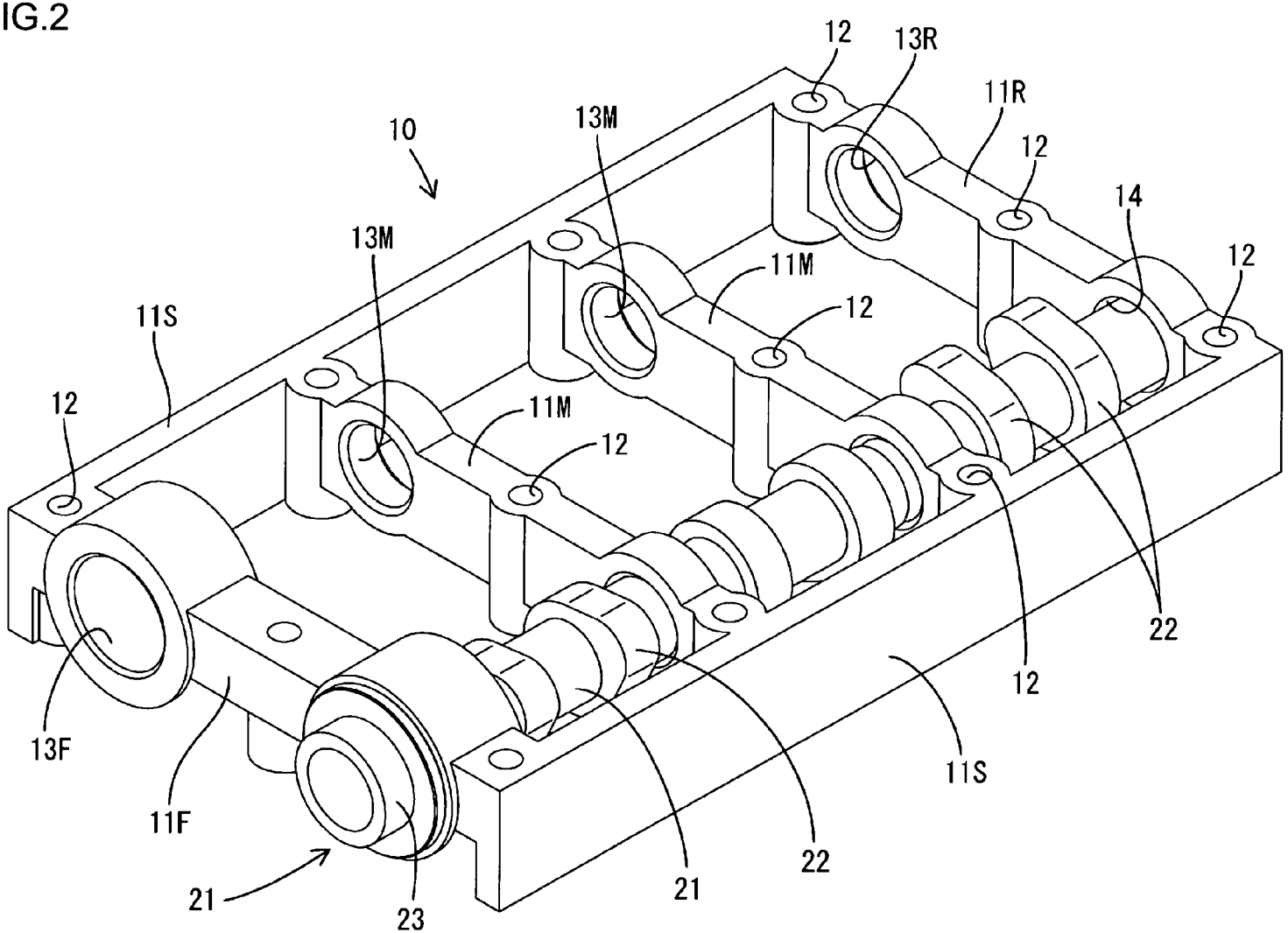
FIG. 2 shows a perspective view of Embodiment 1.
Figure 3:
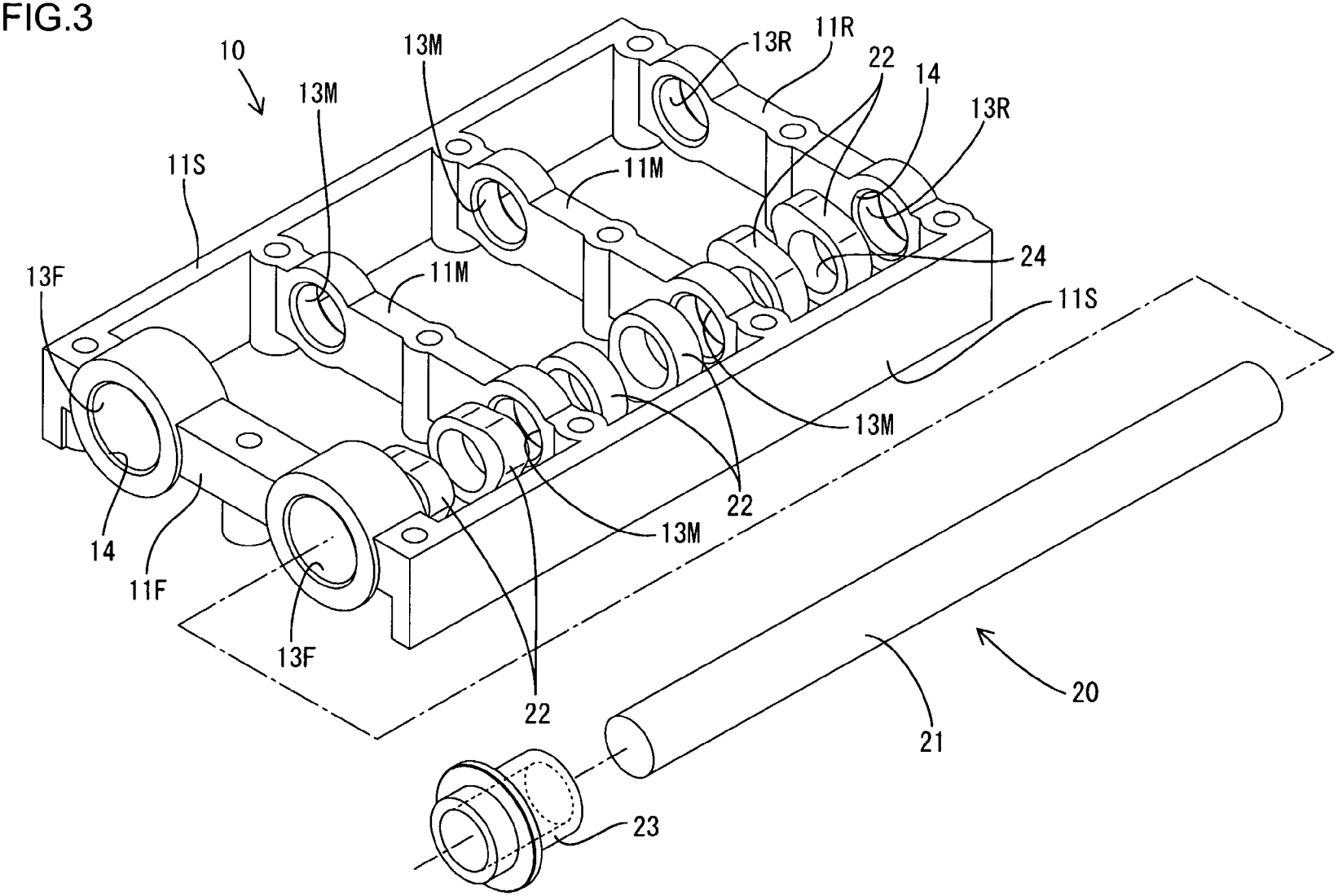
FIG. 3 shows a perspective view where the camshaft is removed from the supporting member.
Figure 4:
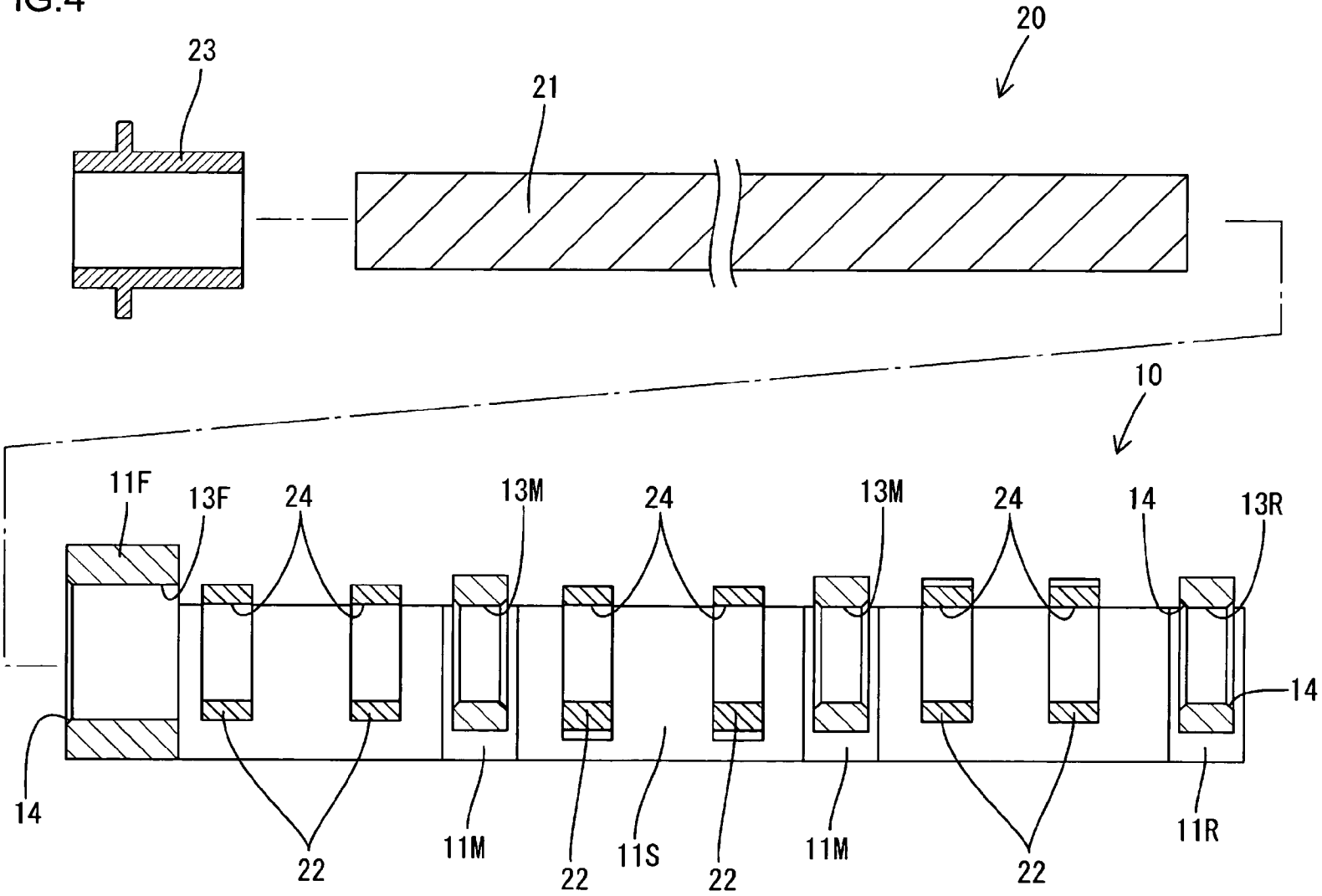
FIG. 4 shows a cross-sectional view where the camshaft is removed from the supporting member.
Figure 5:
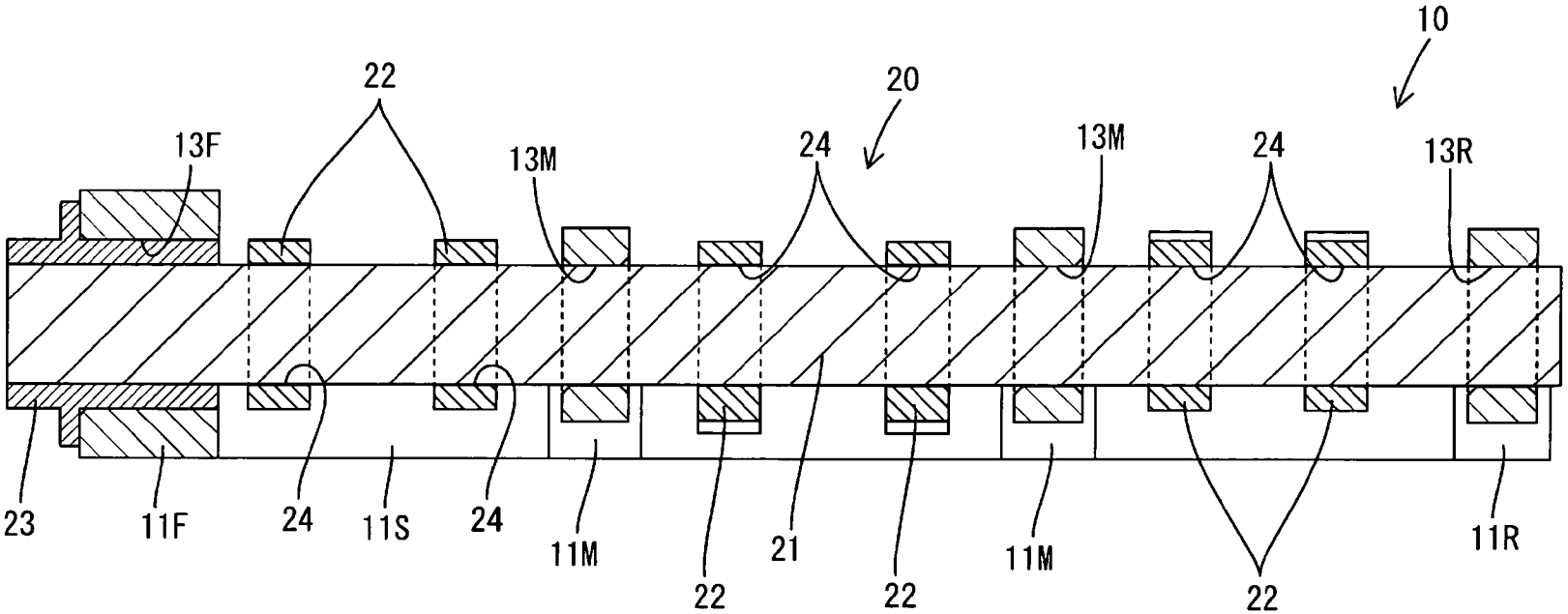
FIG. 5 shows a cross-sectional view where the camshaft is fitted into the supporting member.

As shown in FIGS. 1 to 3, a supporting member 10 is a single part made of metallic material such as aluminum alloy. The supporting member 10 comprised of a pair of right and left side frames 11S, a front frame 11F connecting the side frames 11S at their front ends, a rear frame 11R connecting the side frames 11S at their rear ends, and a pair of front and rear middle frames 11M dividing the area surrounded by the side frames 11S, the front frame 11F, and the rear frame 11R into three in an anteroposterior direction.

Bolt-holes 12 penetrating through in a vertical direction are formed respectively in the front frame 11F, the rear frame 11R, and the pair of middle frames 11M. The bolt-holes 12 are formed in three places in each of the frames: at both right and left ends, as well as at the center in a horizontal direction.

The supporting member 10 is fixed onto the top surface of a cylinder head not shown. The supporting member 10 is fixed onto the top surface of the cylinder head with a bolt (not shown) inserted into the bolt-hole 12.

Circular bearing holes 13F, 13M, and 13R penetrating through the interval portion of the adjacent bolt-holes 12 in an anteroposterior direction are formed respectively in the front frame 11F, the rear frame 11R, and the pair of middle frames 11M. The circular bearing holes 13F, 13M, and 13R are formed in pairs in horizontal direction.

The four bearing holes 13F, 13M, and 13R in the right side are concentrically aligned.

The four bearing holes 13F, 13M, and 13R in the left side are also concentrically aligned.

The internal diameter of the bearing hole 13F formed in the front frame 11F is larger than those of the bearing holes 13M and 13R formed respectively in the middle frame 11M and the rear frame 11R.

The internal diameter of the bearing holes 13M formed in the middle frames 11M is the same as that of the bearing hole 13R formed in the rear frame 11R.

At the opening edge of each of bearing holes 13F, 13M, and 13R, a guide surface 14 in a tapered shape is formed (see FIG. 3).

The thickness of the front frame 11F in an anteroposterior direction is greater than those of the middle frames 11M and the rear frame 11R in an anteroposterior direction.

Each of the front frame 11F, the middle frames 11M, and the rear frame 11R configures a bearing means (bearing part).

Two camshafts 20 are mounted in the supporting member 10.

Each camshaft 20 is comprised of a shaft body 21, six cam lobes 22, and a spacer 23 (see FIG. 3).

The shaft body 21 has a circular cross-section shape. The shaft body 21 has a constant external diameter at least in the area from the front end to the rear end of the supporting member 10.

The external diameter of the shaft body 21 is slightly smaller than the internal diameter of the bearing holes 13M and 13R formed respectively in the middle frame 11M and the rear frame 11R. This size gap enables securing the clearance during insertion of the shaft body 21 into the bearing holes 13M and 13R. And thus, this clearance enables rotatably supporting the shaft body 21 smoothly without rattling in a radial direction.

The spacer 23 is cylindrically-shaped.

The spacer 23 is fitted into, as well as integrally fixed to, the bearing hole 13F formed in the front frame 11F. The spacer 23 is fixed to the bearing hole 13F such that it cannot move both in radial and axial directions.

The internal diameter of the spacer 23 is the same as those of the bearing holes 13M and 13R formed respectively in the middle frame 11M and the rear frame 11R.

The cam lobe 22 has a nearly oval shape as a whole. A circular mounting hole 24 is formed in the cam lobe 22, penetrating through in an anteroposterior direction. The shape of the cam lobe 22 is similar to those of well-known cam lobes.

The internal diameter of the mounting hole 24 is nearly the same as the external diameter of the shaft body 21.

The shaft body 21 is penetrating through the mounting hole 24.

The cam lobe 22 is comprised of a cam base in a circular arc shape being concentric with the mounting hole 24 and a cam nose having a longer distance from the center of the mounting hole 24 to the circumferential surface than that of the cam base.

The maximum distance from the center of the mounting hole 24 to the circumference of the cam nose is longer than the radius of the bearing hole 13F formed in the front frame 11F. In other words, the cam lobe 22 cannot pass through any of the bearing holes 13F, 13M and 13R.

The camshaft 20 is mounted, and at the same time, built up in the supporting member 10. These assemblings are completed in one process.

In this process, firstly, two of the cam lobes 22 are placed in between the front frame 11F and the front side middle frame 11F (i.e., between adjacent bearing holes). Next, two of the cam lobes 22 are again placed in between the middle frames 11M which are in pair back and forth (i.e., between adjacent bearing holes). And finally, again, two of the cam lobes 22 are placed in between the rear side middle frame 11M and the rear frame 11R (i.e., between adjacent bearing holes).

For placing the cam lobes 22, a jig not shown, which has a groove in a shape corresponding to the direction of each of the cam noses, is used, since the directions of the cam noses in each of the cam lobes 22 are individually different.

Each of the cam lobes 22 fitted in the groove of the jig are respectively positioned such that their cam noses are facing to the prescribed directions. Moreover, they are respectively positioned such that the center of the axle of the mounting hole 24 provided in the cam lobe 22 coincides with those of the bearing holes 13F, 13M, and 13R.

And also, the position of each cam lobe 22 in an anteroposterior (axial) direction is fixed with the jig.

A jig vertically nipping the cam lobe 22 may be used as the jig. An escaping part for avoiding interfering with the shaft body 21 is formed in the jig.

With each of the cam lobes 22 positioned with the jig, the shaft body 21 sequentially penetrates through the bearing holes 13F, 13M, and 13R in the supporting member 10, as well as the mounting holes 24 in the cam lobes 22.

The spacer 23 is fitted to the bearing hole 13F in the front frame 11F. The front end of the shaft body 21 is rotatably fitted inside of the spacer 23.

The shaft body 21 penetrates through the bearing holes 13F, 13M, and 13R, the spacer 23, and the mounting holes 24, before each of the cam lobes 22 is fixed to the shaft body 21. Here, each of the cam lobes 22 is fixed to the shaft body 21 so that the cam lobes 22 are integrally rotatable along with the shaft body 21.

As a means for fixing the cam lobe 22 so as to be arranged around the circumference of the shaft body 21, shrink fitting and welding may be used.

When shrink fitting is employed, a heating means is provided to the jig. This enables heating the cam lobe 22 prior to penetrating the shaft body 21 through the mounting hole 24. The internal diameter of the mounting hole 24 is enlarged by heating the cam lobe 22. Then, with the cam lobe 22 heated, the shaft body 21 at normal temperature penetrates through the mounting hole 24. After the shaft body 21 penetrating through, the cam lobe 22 is brought back to the normal temperature. By bringing the cam lobe 22 back to the normal temperature, the internal diameter of the mounting hole 24 contracts. This allows the inner circumference of the mounting hole 24 to tightly adhere to the outer circumference of the shaft body 21. With this friction on the adhering surface, the cam lobe 22 can be rigidly fixed to the shaft body 21.

When welding is employed, after the shaft body 21 penetrating through the mounting hole 24, the cam lobe 22 is fixed to the shaft body 21 by welding, while the cam lobe 22 immobilized with the jig.

The cam lobe 22 is fixed to the shaft body 21 as described above, before the jig is removed from the cam lobe 22.

Accordingly, the assembling, and at the same time, the mounting of the camshaft to the supporting member 10 are completed.

The supporting structure of the camshaft according to the present invention brings about the effect as follows.

A bearing member combining two semi-circular arc shaped concave portions so as to produce a circular shape might disturb a smooth rotation of a camshaft due to the misalignment of the center of axle of the two semi-circular arc shaped concave portions.

In this respect, according to the present invention, the cam lobe 22 is formed as a single part, not formed integrally with a shaft body 21. A mounting hole 24 is provided in the cam lobe 22 for allowing the shaft body 21 to penetrate there through. Moreover, the shaft body 21 penetrates through four bearing holes 13F, 13M, and 13R, and mounting holes 24 arranged in between adjacent bearing holes 13F, 13M, and 13R.

Therefore, according to the present invention, the bearing holes 13F, 13M, and 13R each in a perfect circular shape can be achieved, since there is no need to divide the bearing holes 13F, 13M, and 13R into two semi-circular arc shaped concave portions. Consequently, the camshaft 20 can be supported with the bearing holes 13F, 13M, and 13R so as to rotate smoothly.

Moreover, when the shaft body and the cam lobe are integrated, the external diameter of the part of the shaft body which fits with the bearing hole needs to be larger than the external diameter of the cam lobe, since the cam lobe needs to penetrate through the bearing hole. Therefore, the bearing structure for supporting the camshaft needs to grow in size.

In this respect, according to the present invention, there is no need for the cam lobe 22 to penetrate through the bearing holes 13F, 13M, and 13R, since the cam lobe 22 is a single part, not formed integrally with the shaft body 21. Hence, it is possible to make the external diameter of the bearing holes 13F, 13M, and 13R smaller, thereby enabling downsizing of the bearing structure.

Embodiment 2

Figure 6:
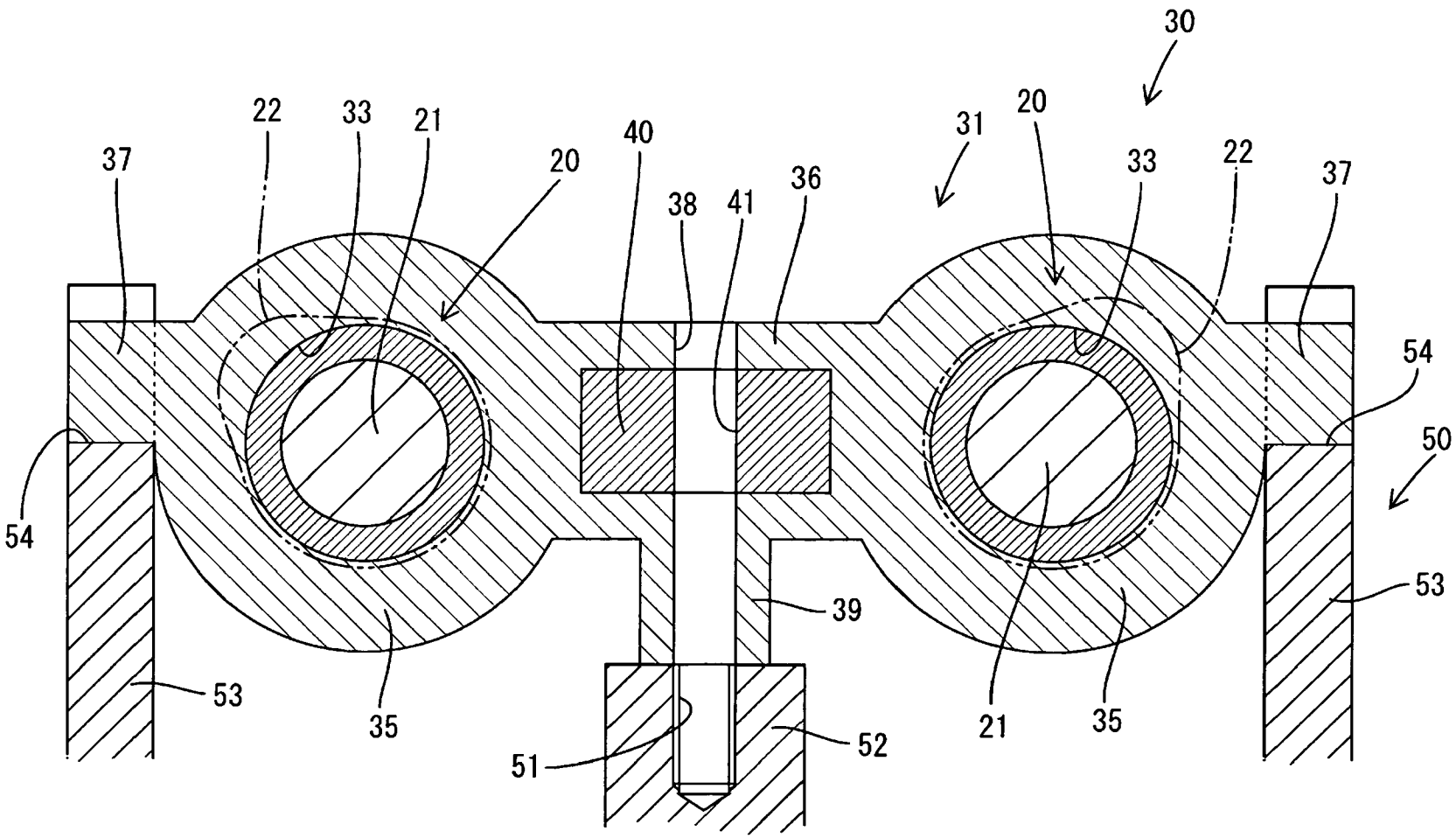
FIG. 6 shows a cross-sectional view of Embodiment 2.
Figure 7:
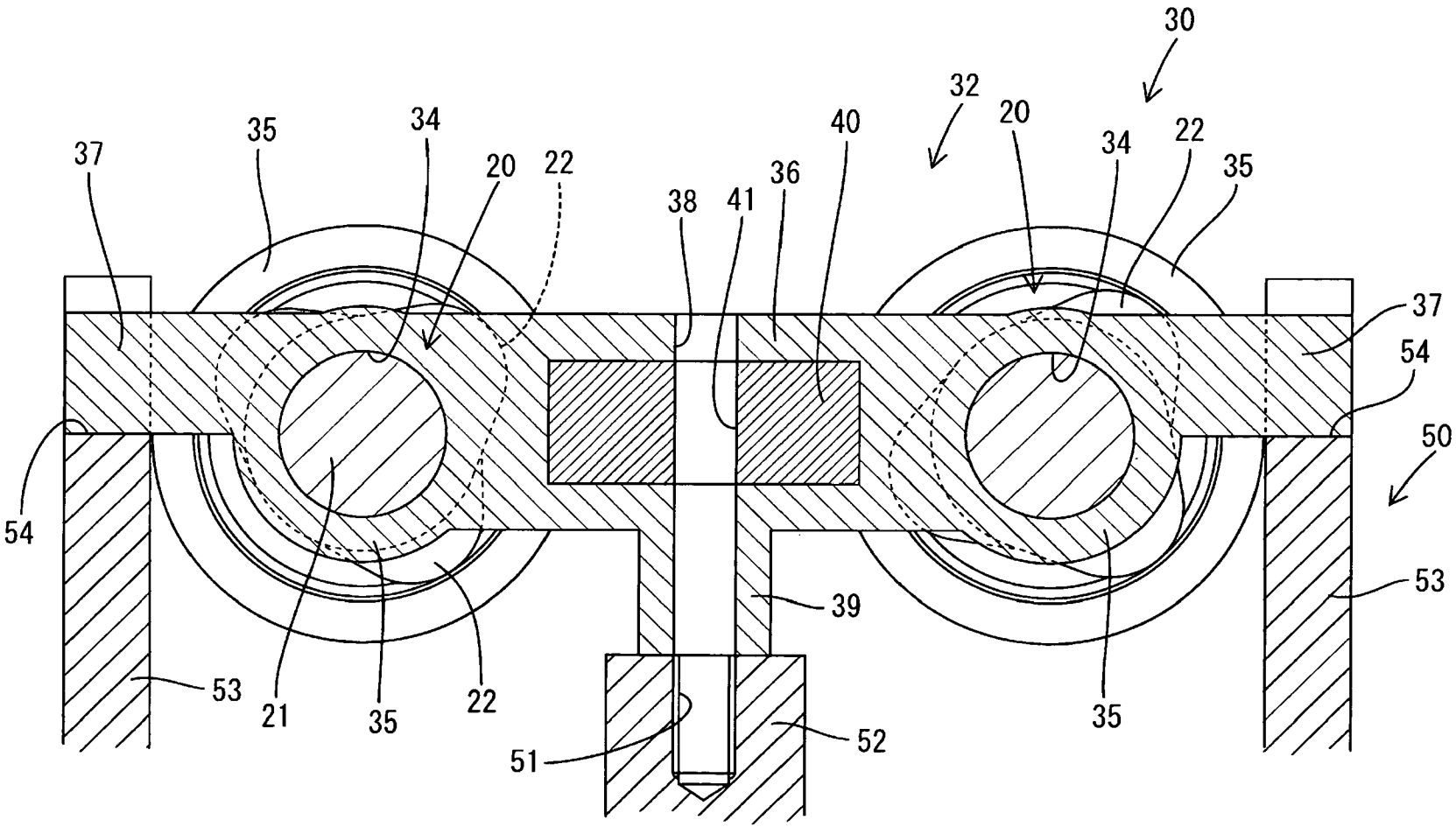
FIG. 7 shows a cross-sectional view of Embodiment 2.

Next, as referring now to FIGS. 6 and 7, Embodiment 2 according to the present invention is described.

In Embodiment 2, a supporting member 30 has a different structure from that in the above Embodiment 1. Since the other structures are the same as those in Embodiment 1, the same reference numbers are allotted to those of the corresponding structures, omitting descriptions on structure, operation, and effect.

While the supporting member 10 in Embodiment 1 is a single part, the supporting member 30 in Embodiment 2 is comprised of four bearing bodies 31 and 32. The supporting member 30 supports two camshafts. Four bearing bodies 31 and 32 are placed in parallel in an anteroposterior direction, fixed to a cylinder head 50.

Four bearing bodies 31 and 32 are made of aluminum alloy.

The bearing body 31 placed in the very front (see FIG. 6) corresponds to the front frame 11F in Embodiment 1. The remaining three bearing bodies 32 (see FIG. 7) correspond to two middle frames 11M and the rear frame 11R in Embodiment 1.

Bearing bodies 31 and 32 respectively have circular bearing holes 33 and 34 in pair which penetrate through each of the bearing bodies 31 and 32 in an anteroposterior direction.

Bearing bodies 31 and 32 are comprised respectively of a pair of bearing parts 35, a connecting part 36 connecting the pair of bearing parts 35, and an ear 37 protruding from the circumference of the pair of bearing parts 35 to the opposite direction of the connecting part 36. The bearing part 35 is formed in a cylindrical shape, concentric with the bearing holes 33 and 34. A bolt-hole 38 is formed in the connecting part 36, penetrating vertically there through.

These four bearing bodies 31 and 32 are mounted onto the top surface of the cylinder head 50, aligned in an anteroposterior direction. These four bearing bodies 31 and 32 are mounted such that the bearing holes 33 and 34 are on one and the same axis.

The bearing bodies 31 and 32 are mounted with a bolt (not shown) inserted into the bolt hole 38, then screwed into a female screw hole 51 in the cylinder head 50.

In the connecting part 36, a projecting portion 39 is formed, projecting downwards. The bottom surface of the projecting portion 39 is contacting with the top surface of a receiving portion 52 in the cylinder head 50. The above-mentioned female screw hole 51 is formed in the receiving portion 52.

The bottom surface of the ear 37 is contacting with the upper end of an upstanding portion 53 in the cylinder head 50. A positioning groove 54 opening upward is formed at the upper end of the upstanding portion 53. The ear 37 is fitting with the positioning groove 54 with its anteroposterior movement restricted.

As mentioned above, the bearing bodies 31 and 32 are mounted to the cylinder head 50 with only a bolt. Also, the both left and right ends of the bearing bodies 31 and 32 are merely placed onto the top surface of the cylinder head 50.

Thus, the connecting part 36 might be deformed when a reaction force from an engine valve not shown affected the cam lobe 22. Moreover, the bearing part 35 might be lifted up due to the reaction force from the engine valve.

To combat this, in Embodiment 2, a reinforcing member 40 made of a metallic material (e.g. iron and steel) having rigidity higher than those of the bearing bodies 31 and 32 is embedded inside the connecting part 36.

The connecting part 36 includes a bolted part and a part extending from the bolted part into left and right sides, continuing to the bearing part 35.

The reinforcing member 40 is embedded inside the connecting part 36 by metallic casting. This enables increasing the rigidity of the connecting part 36, preventing deformation and curvature of the connecting part 36 caused from the reaction force, which is coming from the downside and affecting the cam lobe 22.

Consequently, since there is no need for the bearing bodies 31 and 32 to be fixed to the cylinder head 50 by bolting, downsizing of the ear 37 in width (size in the left and right direction) is possible. Downsizing of the ear 37 in width enables downsizing of the bearing bodies 31 and 32 in width (size in the left and right direction). As a result, the width of the supporting member 30 can be reduced, thereby achieving the downsizing of the bearing structure.

In the present embodiment, an example in which the reinforcing member 40 is not exposed on the outer surface of the bearing bodies 31 and 32 is disclosed, however, a part of the reinforcing member 40 may be exposed on the outer surface of the bearing bodies 31 and 32.

In the reinforcing member 40, a continuous hole 41 which is coaxial with the bolt hole 18 and having the same circumference as the same is formed. Therefore, no trouble occurs when a bole is inserted into the bolt hole 38.

In the present embodiment, an example in which the bearing bodies 31 and 32 are respectively fixed alone to cylinder head 50 is disclosed, however, the bearing bodies 31 and 32 may be united each other with members other than the cylinder head 50.

Other Embodiments

With embodiments of the present invention described above with reference to the accompanying drawings, it is to be understood that the invention is not limited to those precise embodiments, and the embodiments as below, for example, can be within the scope of the present invention.

(1) The number of cam lobes placed in between adjacent bearing holes may be one or three or more.

(2) The number of cam lobes placed in between adjacent bearing holes may be either the same in each arrangement area or different in each arrangement area.

(3) The number of bearing holes formed in a front frame, middle frame, and a rear frame may be three or less, or five or more.

(4) The number of arrangement area for placing cam lobes in between adjacent bearing holes may be two or less, or four or more.

(5) The number of cam lobes possible to be mounted to a shaft body may be five or less, or 7 or more.

(6) The number of cam lobes possible to be mounted to a supporting member may be one or three and more.

(7) The size of the internal diameter of the bearing hole may be identical in every bearing hole.

(8) A means, other than shrink fitting and welding, for firmly fixing a shaft body with a cam lobe so as to rotate integrally may be employed. For example, a shaft body can be firmly fixed to a mounting hole in a cam lobe by expanding the diameter of the tubular shaft body.

(9) The number of bearing holes for supporting a camshaft may be three or less, or five or more.

What is claimed is:

1. A structure for use on a cylinder head, said structure comprising:

a camshaft; and a supporting member configured to support said camshaft and being a single part, wherein said camshaft comprises a shaft body having a circular cross section and a cam lobe being disposed so as to surround the circumference of said shaft body, said supporting member has a plurality of circular bearing holes arranged on a single axis, such that at least two of said circular bearing holes are arranged so as to be adjacent, said cam lobe is a single part, not formed integrally with said shaft body, a mounting hole is disposed in said cam lobe, said mounting hole being configured to enable said shaft body to penetrate therethrough, said shaft body penetrates through said plurality of bearing holes and said mounting hole disposed in said cam lobe arranged in between said adjacent bearing holes, and said cam lobe is integrally fixed to said shaft body.

2. A method for mounting a camshaft to a supporting member for use on a cylinder head, wherein the camshaft comprises a shaft body having a circular cross section and the supporting member is a single part and has a plurality of circular bearing holes arranged on a single axis, such that at least two of the circular bearing holes are arranged so as to be adjacent, said method comprising providing a cam lobe that is a single part, not formed integrally with the shaft body, a mounting hole being disposed in the cam lobe, placing the cam lobe in between the adjacent bearing holes, penetrating the shaft body through the plurality of bearing holes and through the mounting hole disposed in the cam lobe such that the cam lobe is arranged around the circumference of the shaft body, and integrally fixing the cam lobe to the shaft body.

3. A method for manufacturing a camshaft supported by a supporting member for use on a cylinder head, wherein the camshaft comprises a shaft body having a circular cross section the supporting member is a single part and has a plurality of circular bearing holes arranged on a single axis, such that at least two of the circular bearing holes are arranged so as to be adjacent, said method comprising providing a mounting hole disposed in a cam lobe, placing the cam lobe in between the adjacent bearing holes, penetrating the shaft body through the plurality of bearing holes and through the mounting hole disposed in the cam lobe such that the cam lobe is arranged around the circumference of the shaft body, and integrally fixing the cam lobe to the shaft body.

* * * * *